United States Patent [19]

Odoj

[11] 4,159,689

[45] Jul. 3, 1979

[54] WINDSURFER

[75] Inventor: Gerhard Odoj, Munich, Fed. Rep. of Germany

[73] Assignee: Semperit Aktiengesellschaft, Vienna, Austria

[21] Appl. No.: 820,924

[22] Filed: Aug. 1, 1977

[30] Foreign Application Priority Data

Aug. 12, 1976 [CH] Switzerland ..... 10248/76

[51] Int. Cl.[2] ..... B63B 35/00

[52] U.S. Cl. ..... 114/39; 9/2 A

[58] Field of Search ..... 114/39; 9/2 R, 2 C, 9/2 F, 2 S, 2 A, 310 F, 310 E, 11 R, 11 A, 13

[56] References Cited

U.S. PATENT DOCUMENTS

| | | | |
|---|---|---|---|
| 2,508,304 | 5/1950 | Sturtevant | 9/2 A |
| 3,168,751 | 2/1965 | Cavaignac | 9/2 A |
| 3,577,576 | 5/1971 | Lobb | 9/2 A |
| 3,657,753 | 4/1972 | LeBlanc | 9/310 F |
| 3,682,123 | 8/1972 | Edwards | 114/39 |

*Primary Examiner*—Trygve M. Blix
*Assistant Examiner*—D. W. Keen
*Attorney, Agent, or Firm*—Werner W. Kleeman

[57] ABSTRACT

A windsurfer comprising a board-like floating body and a sail connected therewith by means of a mast or pole. The floating body, viewed in cross-section, comprises a number of adjacent hoses communicating with one another, and a rigid plate is arranged between both of the outer hoses.

17 Claims, 4 Drawing Figures

WINDSURFER

BACKGROUND OF THE INVENTION

The present invention relates to a new and improved construction of windsurfer comprising a board-like floating body and a sail connected therewith by means of a mast or pole.

A ring arranged approximately at chest height, fixed to the sail mast and guided about the sail, serves for turning the sail and for holding the user. Various attractions of windsurfing, apart from the athletic aspects, reside for instance in the high speeds which can be obtained, the good maneuverability and so forth, especially also as concerns the relative cost of procuring such equipment.

A notable drawback resides, however, in the extremely unfavorable length of the floating body of three meters and more when transported by means of an automobile, so that transport thereof can only be accomplished on the roof of the automobile or other vehicle. However, when doing so difficulties arise on the one hand, in terms of postively attaching the smooth floating body to the roof of the automobile and, on the other hand, due to the increased air resistance, so that the vehicle can only be driven at lower speeds to avoid subjecting the floating body and the attachment means thereof to increased loads. What is additionally extremely disadvantageous is the relatively high weight both in terms of transporting such to the water where it is to be sailed as well as also the manual transport thereof into the water.

SUMMARY OF THE INVENTION

Hence, with the foregoing in mind it is a primary object of the present invention to provide an improved construction of windsurfer which is not associated with the aforementioned drawbacks and limitations of the prior art proposals.

Yet another object of this invention is to avoid the above-indicated drawbacks by the provision of a stable, inflatable floating body.

Still a further significant object of the present invention aims at the provision of a new and improved construction of windsurfer which is relatively simple in design, economical to manufacture, easy to transport and handle, and possessing good sailing characteristics.

A further significant object of the present invention aims at providing a stable, inflatable floating body which allows for simple transport thereof in the uninflated condition in the trunk of a vehicle.

Yet a further object of the invention is to provide a stable, inflatable floating body for a windsurfer which, owing to its low weight, allows the folded-together floating body to be carried with little effort to the water and at that location inflated.

Now in order to implement these and still further objects of the invention, which will become more readily apparent as the description proceeds, the floating body as contemplated by the invention, viewed in cross-section, comprises a number of adjacently situated hoses which are connected with one another, with a rigid plate or platform member being arranged between both of the outer hoses. This plate predominantly serves for reinforcing the floating body at the region of the anchoring of the sail mast and for generally increasing the torsion resistance.

What is advantageous in order to obtain a high rigidity in the inflated condition is if the floating body, viewed in cross-section, comprises at least four substantially cylindrical, juxtapositioned hoses which are connected with one another, wherein the outermost hoses have a diameter which is at least one-third larger than the inner hoses.

Both of the outer hoses, due to the larger immersion resistance, increase the security against capsizing of the floating body which otherwise is quite prone to doing so by virtue of the high sail mast or pole, whereas the hoses of smaller cross-section increases the rigidity or stiffness. Depending upon the desired size it is possible to use a different random number of hoses.

According to a further preferred exemplary embodiment of the invention it is possible to arrange between both of the outer hoses a rigid plate formed of wood, plastic or the like, wherein, on the one hand, there is available to the user a flat, rigid standing surface and, on the other hand, there can be additionally increased the torsion resistance.

In this regard it is of advantage if the plate is arranged approximately at the center of the boat body and extends over a length of preferably approximately one-third of the length of the floating body, since this region is exposed to a particularly great load due to anchoring of the sail mast.

In order to attach the sail mast there can be vulcanized to the floating body a rubber body, and the plate can be provided at such region with a recess. The rubber body possesses sufficiently great strength for mounting the sail mast and by virtue of its elasticity protectively transmits the forces to the flexible fabric web. The mounting of the sail mast can be, however, directly accomplished at the plate.

A simple and positive connection of the plate with the floating body can be obtained when the plate possesses projections which are introduced into brackets which are adhesively bonded or vulcanized to the floating body. The plate inserted into the brackets in the uninflated condition of the floating body is non-displaceably connected with the floating body and under normal circumstances cannot slide out of the brackets in the inflated condition.

In the event that the inflatable floating body is damaged to such an extent that air escapes, then it is advantageous if it comprises at least two separated chambers each equipped with an inflation valve, so that the floating body itself does not sink in this case.

Furthermore, brackets for attaching a sword and/or fin can be arranged at the underside of the floating body, providing a positive fixation with simple and quick assemby or mountability.

If the rounded portion of the stern and bow possesses an eliptical cross-section then there is provided a favorable streamline shape and an optimum stiffness or rigidity.

An advantageous fixation of the sword resides in providing the floating body at the region of the rigid plate with a slot-shaped opening extending along the lengthwise axis, and a shaft corresponding to the dimensions of the opening is introduced through such opening, this shaft receiving a sword introduced through a corresponding opening of the plate.

This renders possible removal of the sword during transport to and from the water without any problems, and in the case of, for instance, very shallow water, the sword can be raised or completely removed for protective or safety reasons during sailing.

The shaft should prevent any pressing of the wall of the floating body at the region of the slot against the sword, thereby eliminating any possibility of clamping or jamming. In order to more simply move the sword it is advantageous if the end of the sword directed towards the rigid plate is equipped with a handle or grip.

If for attachment of the rigid plate with the hoses there are provided composite profile members of rubber which engage with profile members connected with the rigid plate, then a rapid and simple mounting or assembly is possible. Due to the provision of the rubber profile members there is provided a certain elasticity of the connection which reduces any too pronounced local loading of the sensitive skin of the floating body.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
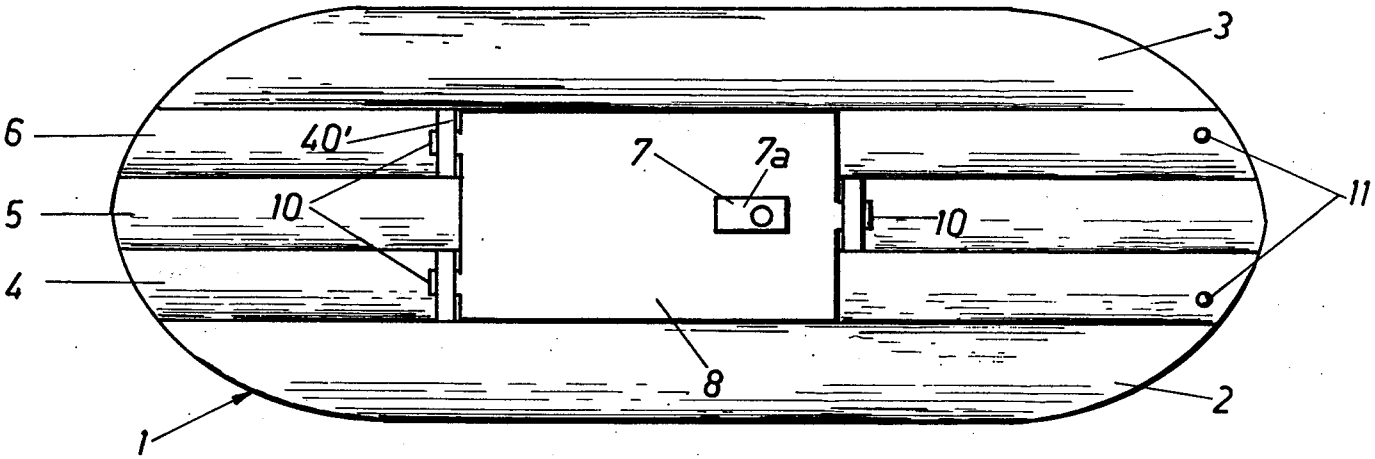
FIG. 1 is a top plan view of the floating body of the windsurfer of the invention.
Figure 2:
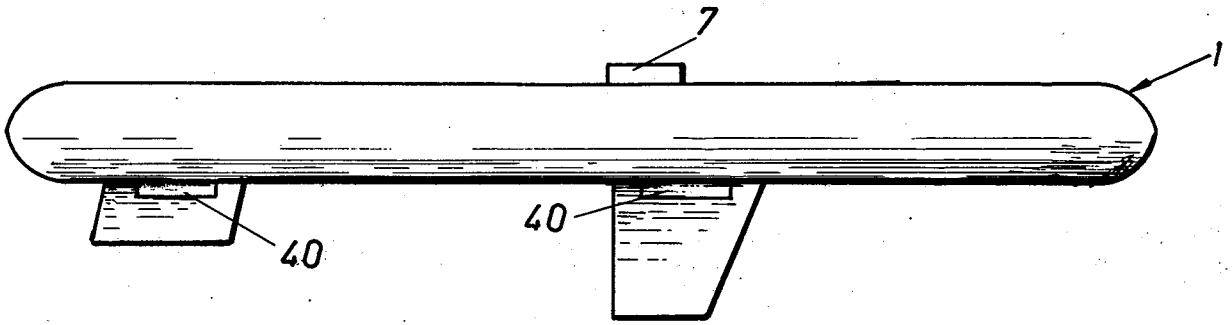
FIG. 2 is a side view thereof.

Describing now the drawings, and by referring specifically to FIGS. 1 and 2, it will be seen that the floating body or boat body 1 possesses both of the lateral or outbound hoses 2 and 3 of larger cross-sectional as well as the inner smaller hoses 4, 5 and 6, of which the central hose or hose member 5 possesses a rubber body 7 serving to mount a not particularly illustrated, but conventional sail mast or pole. The plate 8 serving as a standing or support surface and to increase the torsion resistance, which plate is formed of wood, plastic or the like, possesses projections 10 which are inserted into brackets 40 attached to the floating body 1 in order to fix the plate 8. At the region of the rubber body 7 the plate 8 possesses a recess *7a* enabling insertion of such rubber body 7. This rubber body 7 can be however itself attached also to the plate 8. There are preferably provided at the region of the bow at least two valves 11 which serve to inflate chambers, generally indicated by reference character 45, which are separated from one another.

Brackets 40' or other suitable attachment means for a sword 21 and a fin 30 are provided at the underside of the boat or floating body. Both of these components 21 and 30 which are formed of a rigid material can be fixed in this manner simply and securely in the uninflated condition of the floating body 1 and can no longer be detached in the inflated condition.

The bow and stern sides of the floating body 1 are advantageously symmetrically constructed and curved essentially corresponding to an elliptical curved section. The curvature can be, however, if desired, also semicircular in configuration, particularly then if there is desired an especially large width of the floating body 1. While other configurations are possible, in the case of an elliptical shape, it is desirable if the floating body 1 has a lengthwise axis which is identical with the main axis of the ellipse.

Figure 3:
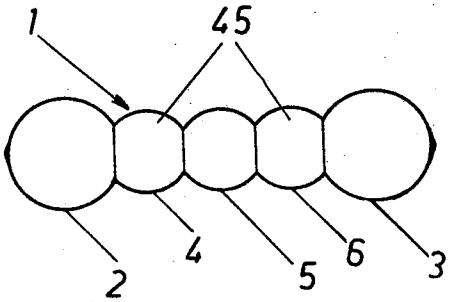
FIG. 3 is a cross-sectional view of the inventive boat body.

In order to increase the security against capsizing, both of the outer hoses 2 and 3, as best seen by referring to FIG. 3, have a diameter which is approximately one-third larger than that of the inner hoses or hose members 4, 5 and 6. These hose members are connected with one another, but for the purpose of increasing the safety of the windsurfer possess at least two mutually separated hollow spaces.

Figure 4:
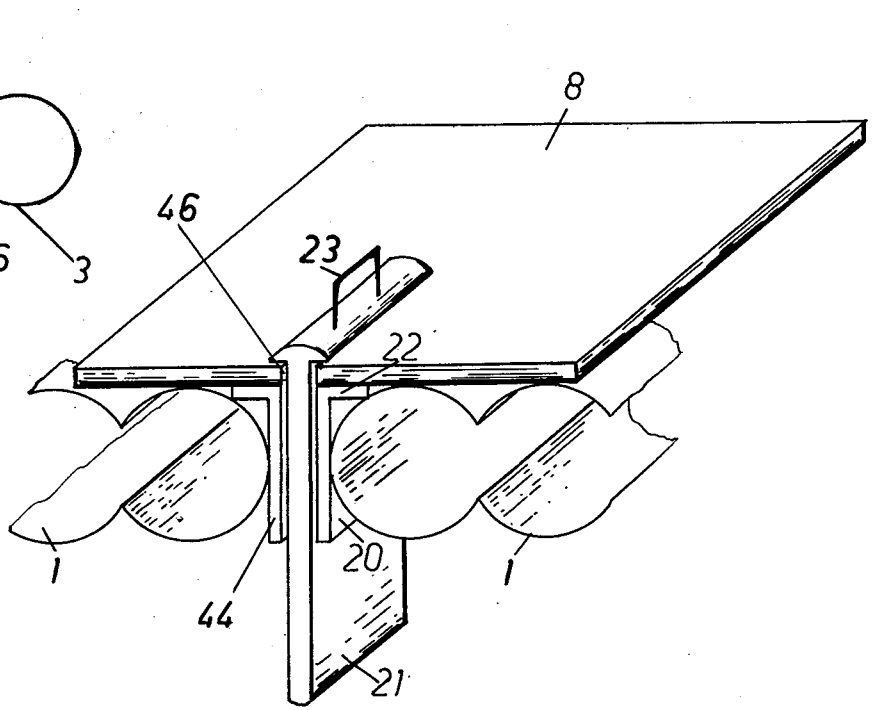
FIG. 4 illustrates an advantageous constructional embodiment for fixing the sword to the boat or floating body.

In order to fix the sword 21, the floating body 1 possesses an opening 44 (FIG. 4) at the region of the rigid plate 8 through which there is guided a shaft or chute 20 attached by the flange means 22 to the rigid plate 8. The sword 21 is guided through the shaft or chute 20 and an extended opening or recess 46 of the rigid plate 8. The sword 21 is equipped with a handle or grip 23 or equivalent structure for facilitating the handling or manipulation thereof.

While there are shown and described present preferred embodiments of the invention it is to be distinctly understood that the invention is not limited thereto, but may be otherwise variously embodied and practiced within the scope of the following claims: Accordingly,

What I claim is:

1. In a windsurfer apparatus including a generally planar horizontal floating body member, a vertical mast connected with said body member, and sail means secured to said mast for capturing the wind which propels the windsurfer, the improvement wherein said horizontal body member comprises:

at least three successively connected parallel contiguous cylindrical inflatable members arranged parallel to the direction of travel of the windsurfer, the outer side pair of inflatable members each having a first outer diameter, the inner inflatable members arranged between said outer side inflatable members each having a second outer diameter less than said first diameter;

a rigid planar horizontal platform member comprising an aperture arranged adjacent the upper surface of said inner inflatable members, the width of said platform member being slightly greater than the spacing distance between said pair of outer side inflatable members;

means connecting said platform member in contiguous relation with the upper surfaces of said inner inflatable members, said platform member being wedged between the outer pair of said inflatable members; and a mast receiving member arranged within said platform member aperture and vulcanized to the upper surface of at least one of said inner inflatable members, whereby the torsional resistance of said body member to the forces applied thereto by said mast and sail means is increased.

2. A windsurfer as defined in claim 1, wherein said connecting means comprises:

bracket means vulcanized with the upper surfaces of said inner inflatable members; and projection means arranged on said platform member for connection with said bracket means.

3. A windsurfer as defined in claim 1, wherein said horizontal body member further comprises:

an even number of inflatable members, said body member containing a longitudinal opening centrally arranged within said platform member and bisecting said inflatable means;

shaft means connected with the under surface of said platform member and arranged within said longitudinal opening bisecting said inflatable members; and sword means arranged within said platform member longitudinal opening and said shaft means.

4. In a windsurfer apparatus including a generally planar horizontal floating body member, a vertical mast connected with said body member, and sail means secured to said mast for capturing the wind to propel the windsurfer, the improvement wherein said horizontal body member comprises:

at least three successively connected parallel contiguous cylindrical inflatable members arranged parallel to the direction of travel of the windsurfer including an outer side pair of inflatable members each having a first outer diameter and inner inflatable members arranged between said outer side inflatable members each inner inflatable member having a second outer diameter, said inflatable members having longitudinal axes arranged in a common plane;

a rigid planar horizontal platform member arranged adjacent the upper surface of said inner inflatable members and approximately centrally of the length of the inflatable members, said platform member spanning the spacing distance between said pair of outer side inflatable members and having a length approximately one-third the length of the horizontal body member; and means connecting said platform member in contiguous relation with the upper surfaces of said inner inflatable members.

5. The improvement as defined in claim 4, wherein:

said floating body member has a rounded stern portion and bow portion, each corresponding in shape to a substantially elliptical section; and said floating body member having a lengthwise axis which is identical with the main axis of the ellipse of the bow and stern.

6. The improvement as defined in claim 4, wherein:

said floating body member includes an underside equipped with means for attachment of a member thereto.

7. The improvement as defined in claim 6, wherein:

said attached member comprises a sword.

8. The improvement as defined in claim 6, wherein:

said attached member comprises a fin.

9. The improvement as defined in claim 4, wherein:

said floating body member possesses a substantially slot-shaped opening along the lengthwise axis of the floating body member at the region of the platform member; shaft means arranged in such slot-shaped opening and having a dimension approximately corresponding to that of said opening; said platform member having another opening; and a sword inserted through said another opening of the platform member and received by said shaft means.

10. The improvement as defined in claim 9, wherein:

said shaft means includes flange means for securing said shaft means to said platform member.

11. The improvement as defined in claim 9, wherein:

an end of said sword which is directed towards the platform member is provided with handle means.

12. The improvement as defined in claim 4, wherein:

said first outer diameter is at least one-third greater than said second outer diameter.

13. The improvement as defined in claim 4, wherein:

said connecting means includes bracket means attached to the floating body and projections on said platform member for engaging with said projections.

14. The improvement as defined in claim 13, wherein:

said bracket means comprise bracket members vulcanized to the floating body.

15. The improvement as defined in claim 13, wherein:

said bracket means comprise bracket members which are adhesively bonded to said floating body.

16. The improvement as defined in claim 4, further including:

said platform member having an aperture;

a mast receiving member vulcanized to the upper surface of at least one of said inner inflatable members and arranged within said aperture.

17. The improvement as defined in claim 4, wherein:

said inflatable members comprise at least two separate air chambers each provided with an inflation valve.

* * * * *